US009513045B2

(12) United States Patent
Cox et al.

(10) Patent No.: US 9,513,045 B2
(45) Date of Patent: Dec. 6, 2016

(54) HEATER-LESS ICE MAKER ASSEMBLY WITH A TWISTABLE TRAY

(71) Applicant: Whirlpool Corporation, Benton Harbor, MI (US)

(72) Inventors: Kevin J. Cox, Berrien Springs, MI (US); Gregory Gene Hortin, Henderson, KY (US); Yen-Hsi Lin, St. Joseph, MI (US); Clayton A. Maas, Zeeland, MI (US); Xi Shan, Cleveland, OH (US); Cristian Soto, Three Oaks, MI (US); Andrew M. Tenbarge, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 682 days.

(21) Appl. No.: 13/782,746

(22) Filed: Mar. 1, 2013

(65) Prior Publication Data

US 2013/0291581 A1 Nov. 7, 2013

Related U.S. Application Data

(60) Provisional application No. 61/642,245, filed on May 3, 2012.

(51) Int. Cl.

| | |
|---|---|
| ***F25C 5/06*** | (2006.01) |
| ***F25C 1/24*** | (2006.01) |
| ***F25C 1/10*** | (2006.01) |

(52) U.S. Cl.

CPC . *F25C 1/24* (2013.01); *F25C 1/10* (2013.01); *F25C 5/06* (2013.01); *F25C 2305/022* (2013.01)

(58) Field of Classification Search

CPC ..... F23C 1/24; F23C 1/10; F23C 1/22; F23C 2305/022

See application file for complete search history.

(56) References Cited

U.S. PATENT DOCUMENTS

| | | | |
|---|---|---|---|
| 1,932,731 | A | 10/1933 | Hathcrne |
| 2,027,754 | A | 1/1936 | Smith |
| 2,878,659 | A | 3/1959 | Prance et al. |

(Continued)

FOREIGN PATENT DOCUMENTS

| | | | |
|---|---|---|---|
| GB | 657353 | | 9/1951 |
| JP | 4260764 | A | 9/1992 |

(Continued)

OTHER PUBLICATIONS

Daehn, et al., "Hyperplastic Forming: Process Potential and Factors Affecting Formablity," MRS Proceedings, 1999, at p. 147, vol. 601.

(Continued)

*Primary Examiner* — Cassey D Bauer

(57) ABSTRACT

An ice maker is provided that includes a tray having recesses that can include ice-phobic surfaces. The ice-phobic surfaces may include ice-phobic coatings, textured metal surfaces, hydrophobic coatings or other surfaces configured to repel water and ice. The tray can be formed from metal material and may exhibit a fatigue limit greater than about 150 Megapascals (MPa) at $10^5$ cycles. The ice maker further includes a frame body coupled to the tray, and a driving body that is rotatably coupled to the tray. The driving body is further adapted to rotate the tray in a clockwise and/or counter-clockwise cycle such that the tray presses against the frame body in a manner that flexes the tray to dislodge ice pieces formed in the recesses of the tray.

8 Claims, 10 Drawing Sheets

(56) References Cited

U.S. PATENT DOCUMENTS

| | | | | |
|---|---|---|---|---|
| 3,033,008 | A | 5/1962 | Davis | |
| 3,071,933 | A | 1/1963 | Shoemaker | |
| 3,075,364 | A * | 1/1963 | Kniffin | F25C 1/24 62/353 |
| 3,093,980 | A | 6/1963 | Frei | |
| 3,159,985 | A | 12/1964 | Keighley | |
| 3,217,510 | A | 11/1965 | Kniffen et al. | |
| 3,217,511 | A | 11/1965 | Keighley | |
| 3,222,902 | A | 12/1965 | Brejcha et al. | |
| 3,228,222 | A | 1/1966 | Maier | |
| 3,426,564 | A | 2/1969 | Jansen et al. | |
| 3,451,237 | A | 6/1969 | Baringer et al. | |
| 3,646,792 | A | 3/1972 | Hertel et al. | |
| 3,677,030 | A | 7/1972 | Nicholas | |
| 4,024,744 | A | 5/1977 | Trakhtenberg et al. | |
| 4,402,194 | A | 9/1983 | Kuwako et al. | |
| 5,177,980 | A | 1/1993 | Kawamoto et al. | |
| 5,378,521 | A | 1/1995 | Ogawa et al. | |
| 5,400,605 | A | 3/1995 | Jeong | |
| 5,617,728 | A | 4/1997 | Kim et al. | |
| 5,675,975 | A | 10/1997 | Lee | |
| 5,768,900 | A | 6/1998 | Lee | |
| 5,826,320 | A | 10/1998 | Rathke et al. | |
| 5,970,725 | A | 10/1999 | Lee | |
| 6,058,720 | A | 5/2000 | Ryu | |
| 6,148,620 | A | 11/2000 | Kumagai et al. | |
| 6,467,146 | B1 | 10/2002 | Herman | |
| 6,481,235 | B2 * | 11/2002 | Kwon | F25C 1/04 249/70 |
| 7,051,541 | B2 | 5/2006 | Chung et al. | |
| 7,131,280 | B2 | 11/2006 | Voglewede et al. | |
| 7,185,508 | B2 | 3/2007 | Voglewede et al. | |
| 7,802,457 | B2 | 9/2010 | Golovashchenko et al. | |
| 7,918,105 | B2 | 4/2011 | Kim | |
| 8,015,849 | B2 | 9/2011 | Jones et al. | |
| 8,099,989 | B2 | 1/2012 | Bradley et al. | |
| 2004/0237566 | A1 * | 12/2004 | Hwang | F25C 5/08 62/345 |
| 2005/0067406 | A1 | 3/2005 | Rajarajan et al. | |
| 2005/0126202 | A1 | 6/2005 | Shoukyuu et al. | |
| 2005/0160757 | A1 | 7/2005 | Choi et al. | |
| 2006/0032262 | A1 * | 2/2006 | Seo | F25C 5/06 62/340 |
| 2006/0086107 | A1 | 4/2006 | Voglewede et al. | |
| 2006/0086134 | A1 | 4/2006 | Voglewede et al. | |
| 2006/0207282 | A1 | 9/2006 | Visin et al. | |
| 2007/0227164 | A1 | 10/2007 | Ito et al. | |
| 2007/0262230 | A1 | 11/2007 | McDermott, Jr. | |
| 2009/0178430 | A1 | 7/2009 | Jendrusch et al. | |
| 2009/0199569 | A1 | 8/2009 | Petrenko | |
| 2010/0011827 | A1 | 1/2010 | Stoeger et al. | |
| 2010/0163707 | A1 | 7/2010 | Kim | |
| 2010/0197849 | A1 | 8/2010 | Momose et al. | |
| 2011/0023502 | A1 | 2/2011 | Ito et al. | |
| 2012/0023996 | A1 | 2/2012 | Herrera et al. | |

FOREIGN PATENT DOCUMENTS

| | | | |
|---|---|---|---|
| JP | 2000346506 | A | 12/2000 |
| KR | 100845860 | B1 | 7/2008 |
| KR | 20100123089 | A | 11/2010 |
| KR | 1020100123089 | A | 11/2010 |
| WO | 2008056957 | A2 | 5/2008 |
| WO | 2008143451 | A1 | 11/2008 |

OTHER PUBLICATIONS

"Nickel Alloys For Electronics," A Nickel Development Institute Reference Book, 1988, 131 pages, Series N 11 002, NiDl Nickel Development Institute.

Shang et al., "Electromagnetically assisted sheet metal stamping," Journal of Materials Processing Technology, 2010, pp. 868-874, 211.

Jimbert et al., "Flanging and Hemming of Auto Body Panels using the Electro Magnetic Forming technology," 3rd International Conference on High Speed Forming, 2008, pp. 163-172.

Daehn, "High-Velocity Metal Forming," ASM Handbook, 2006, pp. 405-418, vol. 14B, ASM International.

European Patent Office, letter transmitting partial European search report for Application No. EP 13163180.6, Aug. 11, 2015, 7 pages.

European Patent Office, European Search Report for Application No. 13163178.0-1605 / 2660541, dated Nov. 19, 2015, 11 pgs.

European Patent Office, European Search Report for Application No. 13163180.6-1605 / 2660540, dated Dec. 8, 2015, 11 pgs.

"Manufacturing Processes—Explosive Sheetmetal Forming," Engineers Handbook, 2006, web archive, last accessed Jan. 19, 2016, at http://www.engineershandbook.com/MfgMethods/exforming.htm, pp. 1-3.

* cited by examiner

HEATER-LESS ICE MAKER ASSEMBLY WITH A TWISTABLE TRAY

CLAIM OF PRIORITY

This application claims priority under 35 U.S.C. §119(e) to U.S. Provisional Patent Application No. 61/642,245, filed May 3, 2012, entitled "HEATER-LESS ICE MAKER ASSEMBLY WITH A TWISTABLE TRAY", which is herein incorporated by reference in its entirety.

FIELD OF THE INVENTION

The present invention generally relates to ice-making apparatus and, more particularly, to ice-making assemblies utilizing a twisting action to a tray to release ice pieces during ice-making operations.

BACKGROUND OF THE INVENTION

The energy efficiency of refrigerator appliances has a large impact on the overall energy consumption of a household. Refrigerators should be as efficient as possible because they are usually operated in a continual fashion. Even a small improvement in the efficiency of a refrigerator appliance can translate into significant annual energy savings for a given household.

Many modern refrigerator appliances possess automatic ice-making capability. Although these ice makers are highly desirable, they have some distinct disadvantages. The automatic ice-making feature, for example, requires more energy-usage than a manual ice-making process (e.g., manual filling of an ice-forming tray and manual ice harvesting). In addition, current automatic ice-forming tray systems are fairly complex, often at the expense of long-term reliability.

More specifically, the harvesting mechanism used by many automatic ice makers is particularly energy-intensive. Like their manual brethren, automatic ice makers usually employ one or more ice-forming trays. Many automatic ice making systems, however, rely on electrical resistance heaters to heat the tray to help release the ice from the tray during an ice-harvesting sequence. These heaters add complexity to the system, potentially reducing the overall system reliability. Just as problematic, the heaters use significant amounts of energy to release ice pieces and cause the refrigerator to expend still further energy to cool the environment that has been heated.

BRIEF SUMMARY OF THE INVENTION

One aspect of the present invention is to provide an ice maker that includes a tray having recesses with ice-phobic surfaces. The ice maker also includes a frame body that is coupled to the tray and a driving body that is rotatably coupled to the tray. The tray is formed from substantially metal material. The driving body is further adapted to rotate the tray in a cycle such that the tray presses against the frame body in a manner that flexes the tray to dislodge ice pieces formed in the recesses.

A further aspect of the present invention is to provide an ice maker that includes a tray having recesses with an ice-phobic coating. The ice maker also includes a frame body that is coupled to the tray and a driving body that is rotatably coupled to the tray. The tray is formed from substantially metal material. The driving body is further adapted to rotate the tray in a cycle such that the tray presses against the frame body in a manner that flexes the tray to dislodge ice pieces formed in the recesses.

Another aspect of the present invention is to provide an ice maker that includes a tray having recesses. The ice maker also includes a frame body that is coupled to the tray and a driving body that is rotatably coupled to the tray. The tray is formed from substantially metal material exhibiting a fatigue limit greater than about 150 Megapascals (MPa) at $10^5$ cycles. The driving body is further adapted to rotate the tray in a cycle such that the tray presses against the frame body in a manner that flexes the tray to dislodge ice pieces formed in the recesses.

One further aspect of the present invention is to provide an ice maker that includes an ice-forming tray with ice-forming recesses having ice-phobic surfaces. The tray is formed from metal material. The ice maker further includes a frame body coupled to the tray, and a driving body that is rotatably coupled to the ice-forming tray. The driving body is further adapted to rotate the tray in a cycle such that the tray presses against the frame body in a manner that flexes the tray for dislodging ice pieces.

Another aspect of the present invention is to provide an ice maker that includes an ice-forming tray with ice-forming recesses having ice-phobic surfaces. The tray is configured with two ends, the first end having a flange. Further, the tray is formed from metal material. The ice maker further includes a frame body coupled to the tray, and a driving body that is rotatably coupled to the ice-forming tray. The driving body is further adapted to rotate the tray in a cycle such that the flange presses against the frame body in a manner that flexes the tray for dislodging ice pieces.

An additional aspect of the present invention is to provide an ice maker that includes an ice-forming tray with ice-forming recesses having ice-phobic surfaces. The tray is configured with a first end having a first flange and a second end having a second flange. Further, the tray is formed from metal material. The ice maker further includes a frame body coupled to the tray, and a driving body that is rotatably coupled to the ice-forming tray. The driving body is further adapted to rotate the tray in a cycle such that the first flange and the second flange alternate pressing against the frame body in a manner that flexes the tray for dislodging ice pieces.

A further aspect of the present invention is to provide an ice-forming tray assembly with ice-forming recesses having an ice-phobic coating. The tray is formed from metal material. The ice-forming tray assembly further includes a frame body coupled to the tray, and a driving body that is rotatably coupled to the ice-forming tray. The driving body is further adapted to rotate the tray in a cycle such that the tray presses against the frame body in a manner that flexes the tray for dislodging ice pieces.

The present invention further provides an ice-forming tray assembly that includes an ice-forming tray with ice-forming recesses having an ice-phobic coating. The tray is configured with two ends, the first end having a flange. In addition, the tray is formed from metal material. The ice-forming tray assembly further includes a frame body coupled to the tray, and a driving body that is rotatably coupled to the ice-forming tray. The driving body is further adapted to rotate the tray in a cycle such that the flange presses against the frame body in a manner that flexes the tray for dislodging ice pieces.

An additional aspect of the present invention is to provide an ice-forming tray assembly that includes an ice-forming tray with ice-forming recesses having an ice-phobic coating. The tray is configured with a first end having a first flange and a second end having a second flange. In addition, the tray is formed from metal material. The ice-forming tray assembly further includes a frame body coupled to the tray, and a driving body that is rotatably coupled to the ice-forming tray. The driving body is further adapted to rotate the tray in a cycle such that the first flange and the second flange alternate pressing against the frame body in a manner that flexes the tray for dislodging ice pieces.

Another aspect of the present invention is to provide an ice-forming tray assembly that includes an ice-forming tray with ice-forming recesses. The tray is formed from metal material exhibiting a fatigue limit greater than about 150 Megapascals (MPa) at $10^5$ cycles. The ice-forming tray assembly further includes a frame body coupled to the tray, and a driving body that is rotatably coupled to the ice-forming tray. The driving body is further adapted to rotate the tray in a cycle such that the tray presses against the frame body in a manner that flexes the tray for dislodging ice pieces.

A still further aspect of the present invention is to provide an ice-forming tray assembly that includes an ice-forming tray with ice-forming recesses. The tray is configured with two ends, the first end being a flange. In addition, the tray is formed from metal material exhibiting a fatigue limit greater than about 150 MPa at $10^5$ cycles. The ice-forming tray assembly further includes a frame body coupled to the tray, and a driving body that is rotatably coupled to the ice-forming tray. The driving body is further adapted to rotate the tray in a cycle such that the flange presses against the frame body in a manner that flexes the tray for dislodging ice pieces.

An additional aspect of the present invention is to provide an ice-forming tray assembly that includes an ice-forming tray with ice-forming recesses. The tray is configured with a first end having a first flange and a second end having a second flange. In addition, the tray is formed from metal material exhibiting a fatigue limit greater than about 150 MPa at $10^5$ cycles. The ice-forming tray assembly further includes a frame body coupled to the tray, and a driving body that is rotatably coupled to the ice-forming tray. The driving body is further adapted to rotate the tray in a cycle such that the first flange and the second flange alternate pressing against the frame body in a manner that flexes the tray for dislodging ice pieces.

These and other features, advantages, and objects of the present invention will be further understood and appreciated by those skilled in the art by reference to the following specification, claims, and appended drawings.

DETAILED DESCRIPTION

It is to be understood that the invention is not limited to the particular embodiments of the invention described below, as variations of the particular embodiments may be made and still fall within the scope of the appended claims. The terminology employed is for the purpose of describing particular embodiments, and is not intended to be limiting. Instead, the scope of the present invention will be established by the appended claims.

Where a range of values is provided, each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

Figure 1:
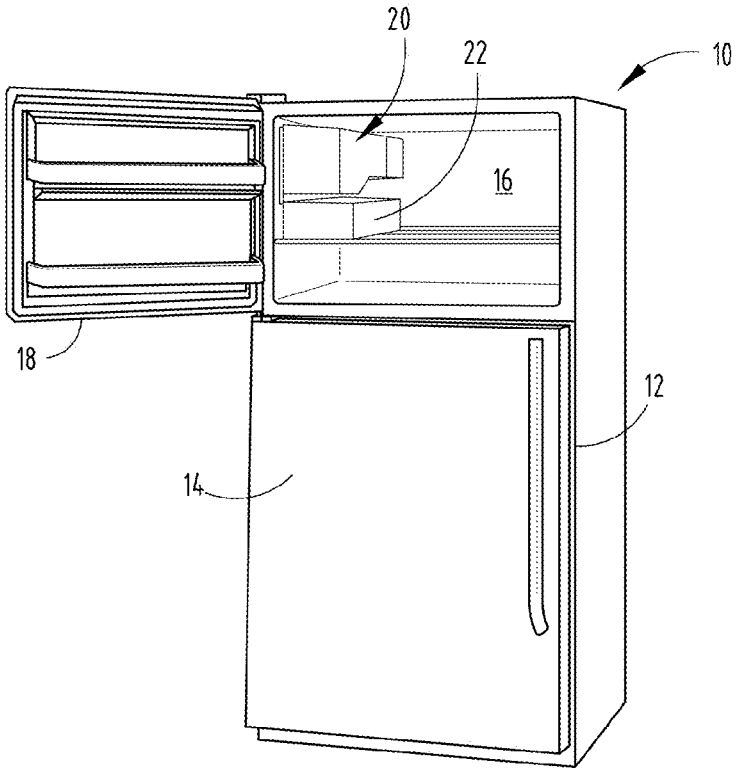
FIG. 1 is a perspective view of a refrigerator appliance with the freezer door in an open position and illustrating an automatic ice maker.

As depicted in FIG. 1, a refrigerator 10 includes a fresh food compartment 12, a fresh food compartment door 14, a freezer compartment 16, and freezer compartment door 18. Freezer compartment door 18 is shown in an open position in FIG. 1, revealing an automatic ice maker 20 and ice piece collection receptacle 22. Also, FIG. 1 shows the refrigerator as a top-mount freezer configuration, but it should be understood that a refrigerator may be any configuration, such as a French door bottom-mount freezer or side-by-side configuration. Located within ice maker 20 is an ice-making assembly 30. It should be understood that the ice maker 20 and ice-making assembly 30 can be configured in various locations within refrigerator 10, including within the fresh food compartment 12, fresh food compartment door 14 and freezer door 18. Also, the automatic ice maker 20 and ice making assembly 30 may be used within any freezer environment, including freezer, ice-making and ice-storage appliances.

Figure 1A:
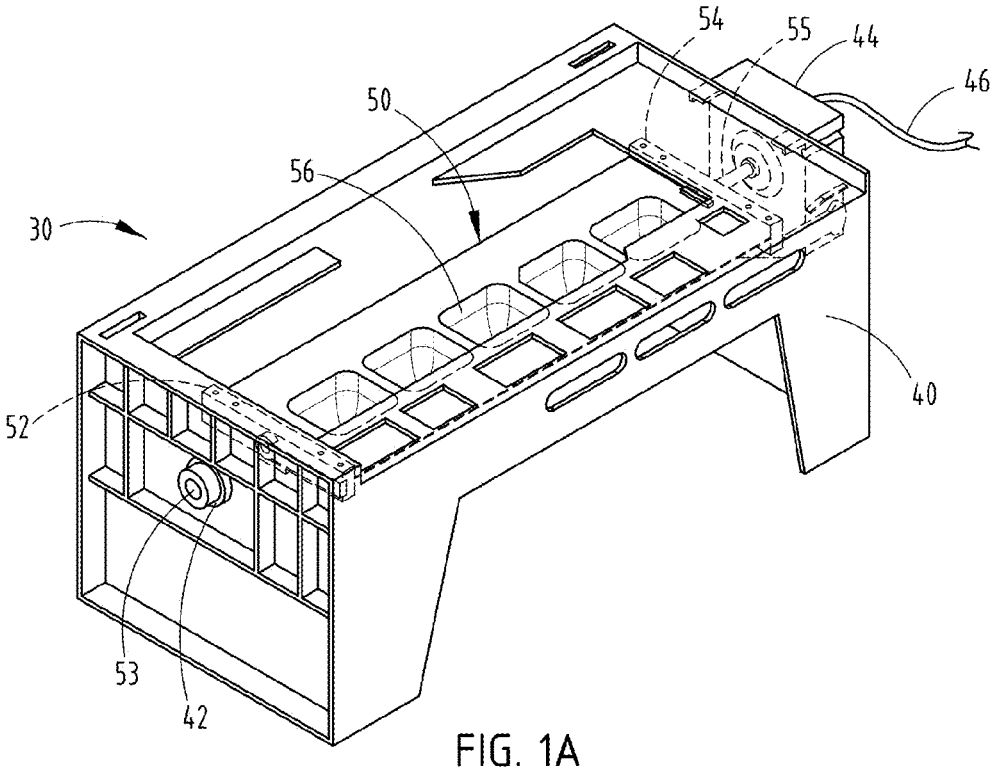
FIG. 1A is a perspective view of an ice maker that includes an ice-making assembly configured to release ice pieces during ice making operations.

An ice-making assembly 30 is depicted in FIG. 1A. The assembly includes a frame body 40 that may be secured to the freezer compartment 16 (not shown) or some other stable, supporting surface within the refrigerator 10. The frame body 40 may be constructed of any of a number of durable, rigid (e.g., possess a relatively high elastic modulus), food-safe materials including certain polymeric and metal materials. It should also be understood that the frame body 40 can be fabricated in various configurations, sizes and orientations, provided that the frame body 40 can be fastened to surface(s) within refrigerator 10 and provide support for other components of the ice-making assembly 30. The frame body 40 typically has end walls 36 and side elevating walls 38 on each side that form support legs and elevate the ice-forming tray 50.

As shown in FIG. 1A, an ice-forming tray 50 is located within the frame body 40. The ice-forming tray 50 includes a plurality of ice-forming recesses 56, a first tray connector 52 and a second tray connector 54. The recesses may be in a single row, multiple rows or staggered from one another. As shown in FIGS. 1A-3D, first tray connector 52 includes a tray connector pin 53 that is coupled to the frame body 40. In particular, tray connector pin 53 rests within a frame body hub 42 (FIG. 1A), allowing tray 50 to rotate along the axis of pin 53.

Second connector 54 includes a tray connector pin 55 that is coupled to a driving body 44 via driving body hub 55*a*. Driving body 44 is adapted to impart clock-wise and counter-clockwise rotational motion to tray 50 via its connection to tray 50 by pin 55 and hub 55*a*. Driving body 44 is powered by power supply 46 and may be configured as a standard 12V electric motor. Driving body 44 may also comprise other rated, electrical motors or a drive mechanism that applies a rotational force to pin 55. Pin 55 and hub 55*a* may also take any suitable coupling configuration, enabling driving body 44 to apply torque and rotational motion to tray 50. In addition, other gearing (not shown) can be employed to change the rotational forces and torque applied by driving body 44 to tray 50.

Although not depicted in FIG. 1A, the apparatus for filling the ice-forming recesses 56 of tray 50 with water (or other desired liquids) may comprise any of the various, known configurations for performing this function. Various tubing, pumps, metering devices and sensors can be used in conjunction with a controller to dispense water into the tray 50 during ice-making operations. The controller (not shown) can be configured to control the water dispensing aspect of the ice-making assembly 30, along with the ice harvesting and freezing aspects of the operation.

Figure 1B:
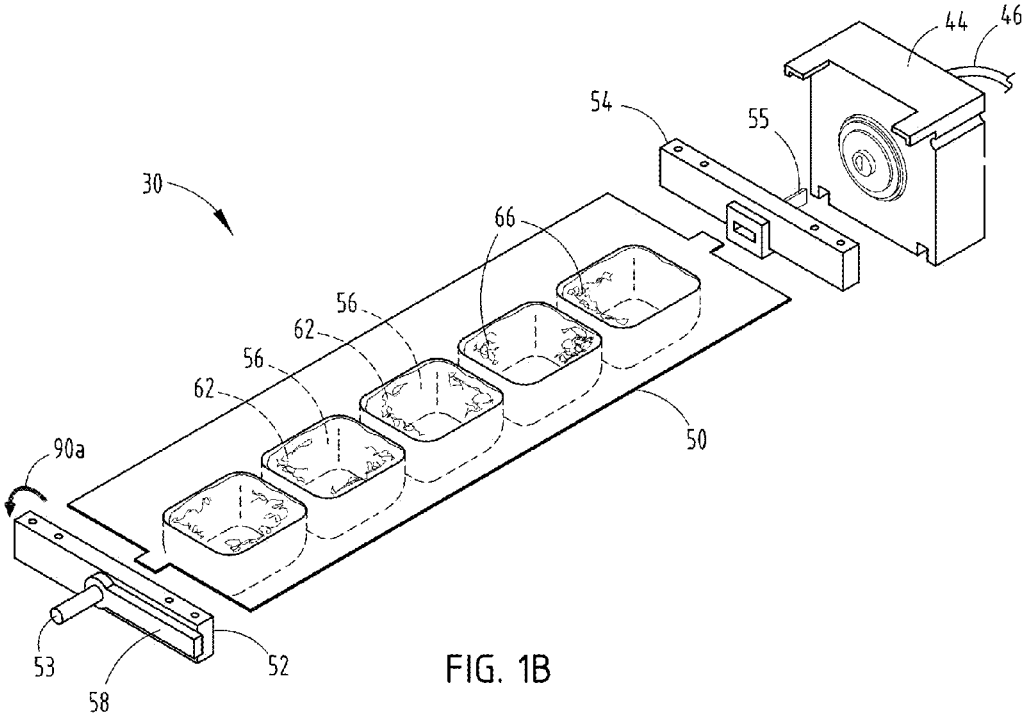
FIG. 1B is a perspective, exploded view of the ice-making assembly illustrated in FIG. 1A with a single-twist, ice-forming tray that can flex in a single, counter-clockwise direction to release ice pieces.

Referring to FIG. 1B, an ice-making assembly 30 is depicted in an exploded view with a single-twist, ice-forming tray 50 configured to flex in a single, counter-clockwise direction 90*a*. Tray 50 includes ice-forming recesses 56 having ice-phobic surfaces 62. Ice-phobic surfaces 62, however, are optional. As shown, the first tray connector 52 also includes a first-twist flange 58. The first-twist flange 58 allows single-twist tray 50 to flex in a single, counter-clockwise direction 90*a* to dislodge ice pieces 66 formed in recesses 56 during ice-harvesting operations. Driving body 44 is configured to rotate single-twist tray 50 in a counter-clockwise direction 90*a* until flange 58 presses against frame body 40 (not shown).

Figure 1C:
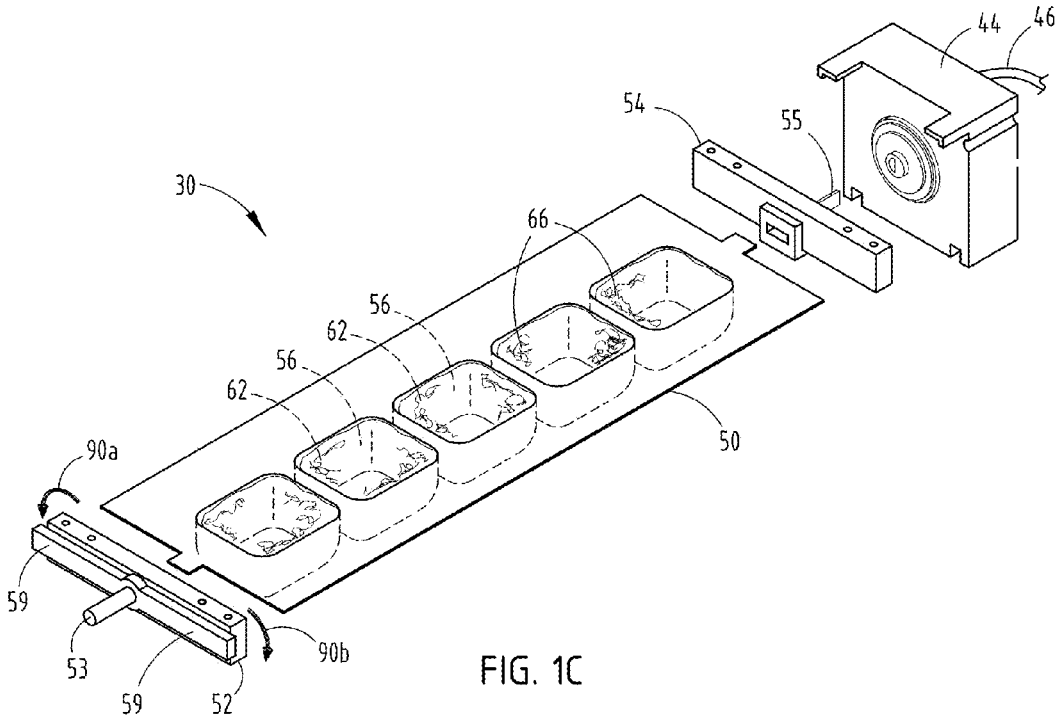
FIG. 1C is a perspective, exploded view of an ice-making assembly with a dual-twist, ice-forming tray that can flex in two directions to release ice pieces, a clockwise direction and a counter-clockwise direction.

FIG. 1C shows an ice-making assembly 30 in an exploded view with a dual-twist, ice-forming tray 50 configured to flex in two directions, a counter-clockwise direction 90*a* and a clockwise direction 90*b*. Dual-twist tray 50, as shown, is configured nearly the same as single-twist tray 50 shown in FIG. 1B. The first tray connector 52, however, includes a second-twist flange 59, which may be one continuous piece or two separate flanges positioned in close proximity to or abutting one another. This second-twist flange 59 allows the dual-twist tray 50 to flex in a second, clockwise direction 90*b* to dislodge ice pieces 66 formed in recesses 56 during ice-harvesting operations. Dual-twist tray 50 may also flex in a first, counter-clockwise direction 90*a* to dislodge ice pieces. Here, driving body 44 is configured to rotate dual-twist tray 50 in a counter-clockwise direction 90*a* until flange 58 presses against frame body 40 (not shown), and rotate dual-twist tray 50 in a clockwise direction 90*b* until flange 59 presses against frame body 40. Both of these actions release ice pieces from tray 50.

Figure 2A:
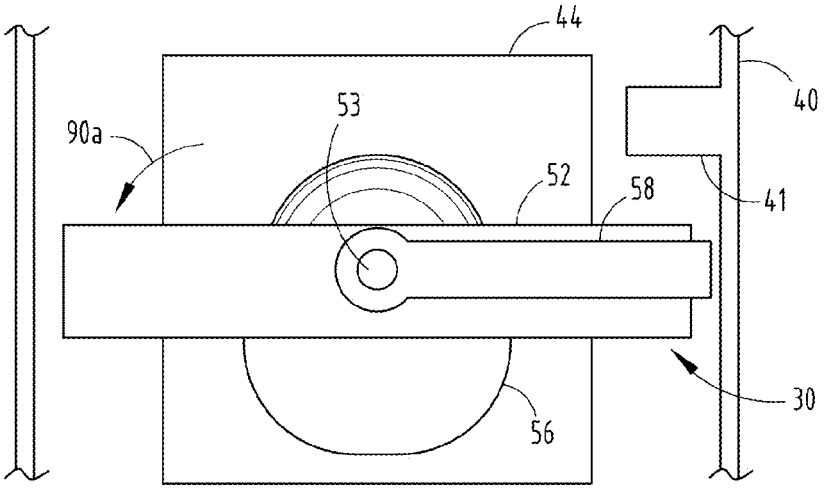
FIG. 2A is an elevated end, cut-away view of an ice-making assembly with an ice-forming tray that can flex in a single, counter-clockwise direction in an ice-filling position.

FIGS. 2A, 2B, 2C and 2D illustrate the ice harvesting procedure that may be employed with the single-twist tray 50 depicted in FIG. 1B. Each of these figures depicts an elevated end, cut-away view of single-twist tray 50, connector 52, flange 58, frame body 40 and a frame body stopper 41 integral to frame body 40. In FIG. 2A, single-twist tray 50 is driven to a level position by driving body 44. Water-filling and ice-forming operations can be conducted when tray 50 is in this level position. Water is dispensed into recesses 56 with water-dispensing apparatus (not shown). The water then freezes into ice-pieces within recesses 56.

Figure 2B:
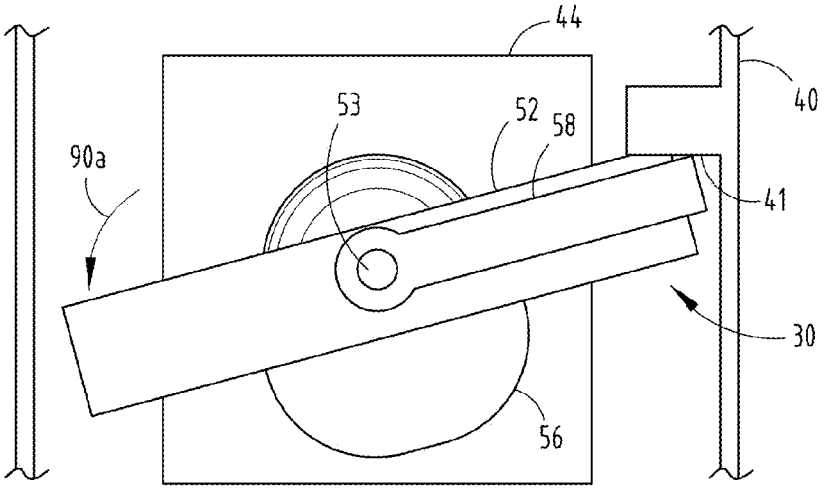
FIG. 2B is an elevated end, cut-away view of the ice-making assembly and ice-forming tray depicted in FIG. 2A with the tray oriented in a counter-clockwise-rotated position and one of its flanges pressing against the frame body of the ice-making assembly.

FIG. 2B depicts the initial phase of the ice-harvesting procedure for single-twist tray 50. Here, driving body 44 rotates tray 50 in a counter-clockwise direction 90*a* such that flange 58 is raised in an upward direction toward frame body stopper 41. This rotational phase continues until flange 58 begins to press on frame body 40 and, more specifically, frame body stopper 41. Frame body 40 and stopper 41 are essentially immobile, coupled to a surface within refrigerator 10 (not shown).

Figure 2C:
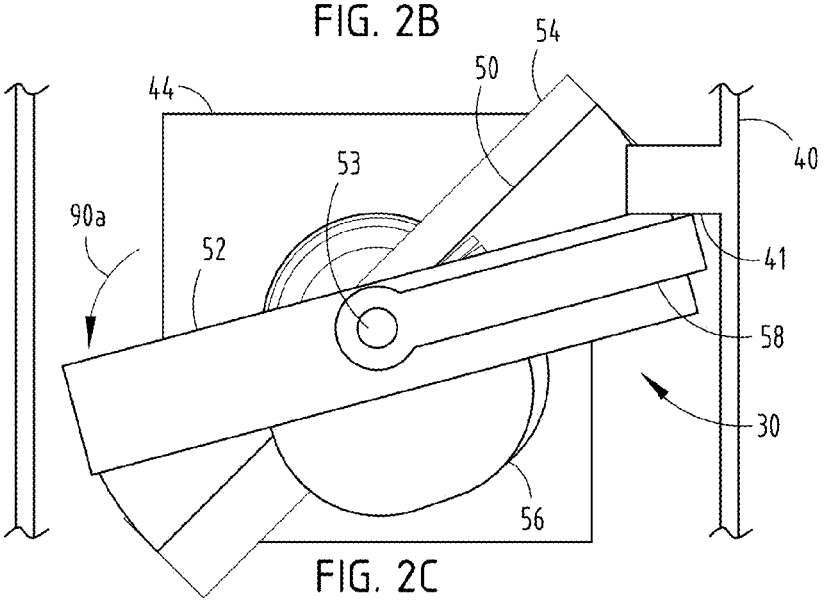
FIG. 2C is an elevated end, cut-away view of the ice-making assembly and ice-forming tray depicted in FIG. 2A with the tray oriented in a counter-clockwise-rotated position, one of its flanges pressing against the frame body of the ice-making assembly and the tray twisted clockwise to an ice-release position.
Figure 2D:
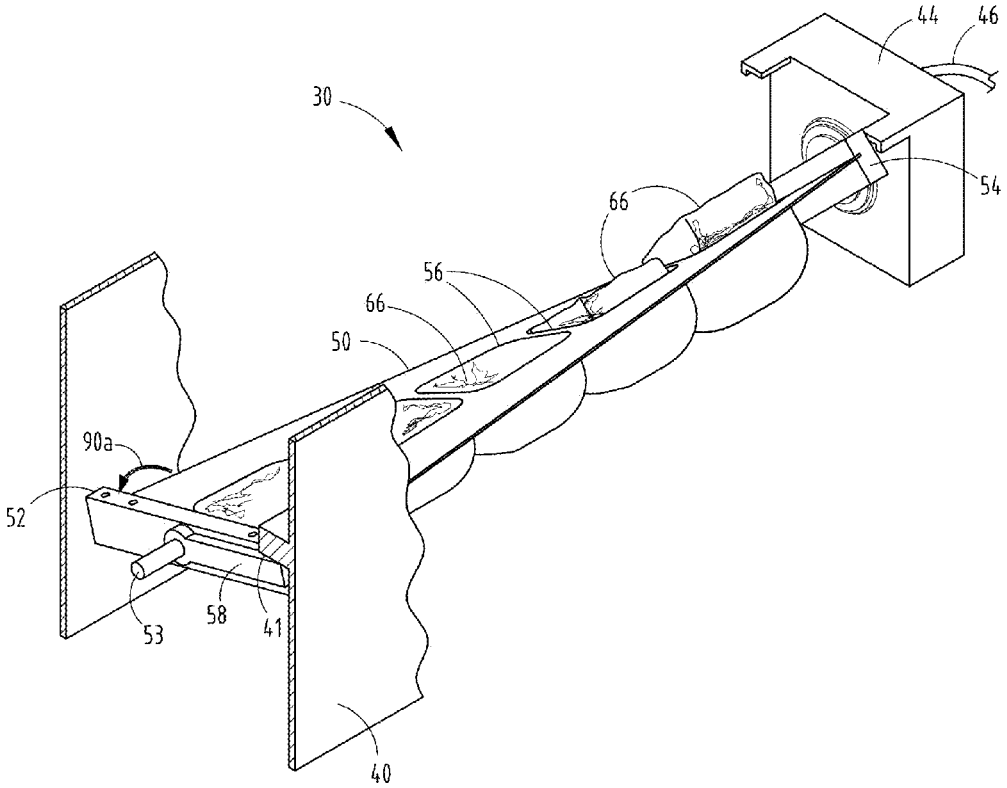
FIG. 2D is a perspective view of the single-twist, ice-forming tray depicted in FIG. 2C, depicted in a counter-clockwise, flexed condition during ice-harvesting operations.

FIG. 2C depicts the last phase of the ice-harvesting procedure for single-twist tray 50. Driving body 44 continues to rotate tray 50 in a counter-clockwise direction 90*a* despite the fact that flange 58 is pressing against frame body 40 and stopper 41. As a result, tray 50 twists and flexes in the counter-clockwise direction 90*a* as shown in FIG. 2D. This twisting and flexing action causes the ice pieces 66 formed in recesses 56 to release from tray 50 and fall into ice collection receptacle 22 (not shown), typically without any other forces or heat being applied to the formed ice pieces 66.

Figure 3A:
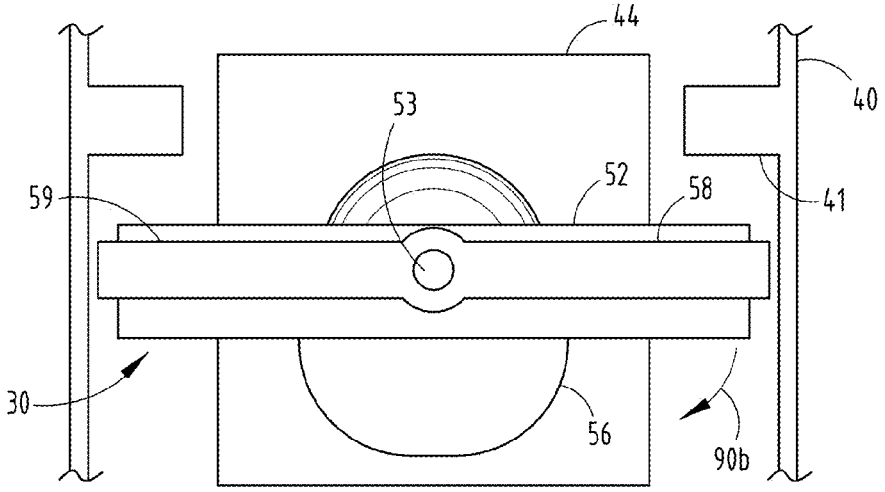
FIG. 3A is an elevated end, cut-away view of an ice-making assembly with an ice-forming tray that can flex in two directions, a clockwise direction and a counter-clockwise direction, and the tray located in an ice-filling position.

FIGS. 3A, 3B, 3C and 3D illustrate the ice harvesting procedure that may be employed with the dual-twist tray 50 depicted in FIG. 1C. Each of these figures depicts an elevated end, cut-away view of dual-twist tray 50, connector 52, flanges 58 and 59, frame body 40 and a frame body stoppers 41 integral to frame body 40. In FIG. 3A, single-twist tray 50 is driven to a level position by driving body 44. Water-filling and ice-forming operations can be conducted when dual-twist tray 50 is in this level position. Water is dispensed into ice-forming recesses 56 with water-dispensing apparatus (not shown). The water then freezes into ice pieces 66 within recesses 56.

Figure 3B:
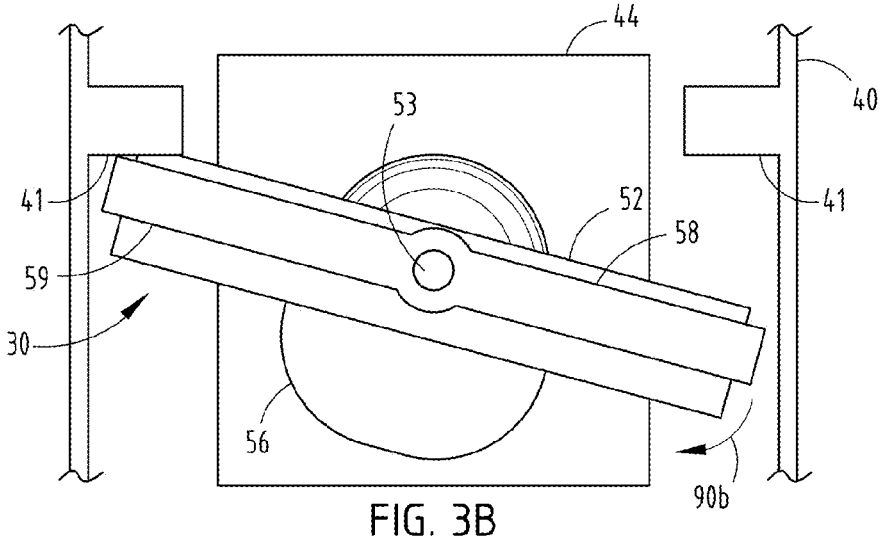
FIG. 3B is an elevated end, cut-away view of the ice-making assembly and ice-forming tray depicted in FIG. 3A with the tray oriented in a clockwise-rotated position and one of its flanges pressing against the frame body of the ice-making assembly.

FIG. 3B depicts the initial phase of the ice-harvesting procedure for dual-twist tray 50. Here, driving body 44 rotates tray 50 in a clockwise direction 90*b* such that flange 59 is raised in an upward direction toward frame body stopper 41. This rotational phase continues until flange 59 begins to press on frame body 40 and, more specifically, frame body stopper 41. Frame body 40 and stopper 41 are essentially immobile, coupled to a surface within refrigerator 10 (not shown).

Figure 3C:
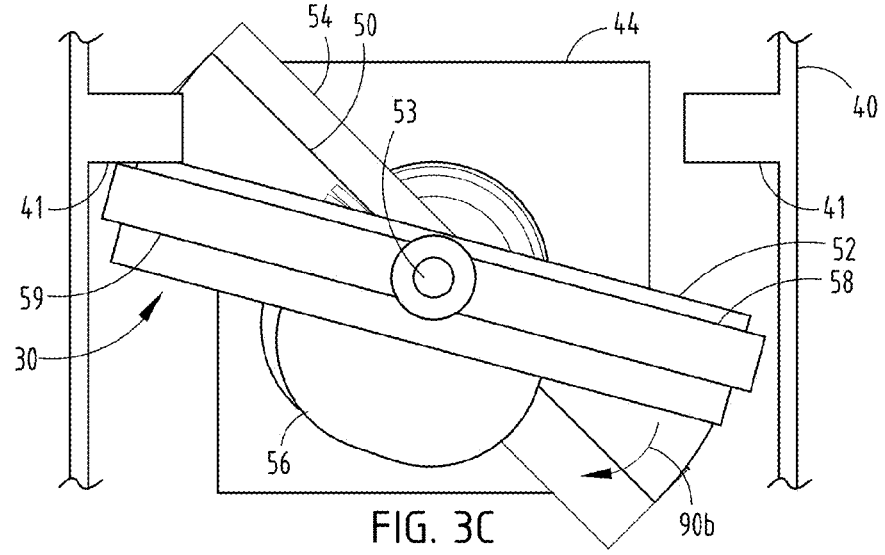
FIG. 3C is an elevated end, cut-away view of the ice-making assembly and ice-forming tray depicted in FIG. 3A with the tray oriented in a clockwise-rotated position, one of its flanges pressing against the frame body of the ice-making assembly and the tray twisted counter-clockwise to an ice-release position.
Figure 3D:
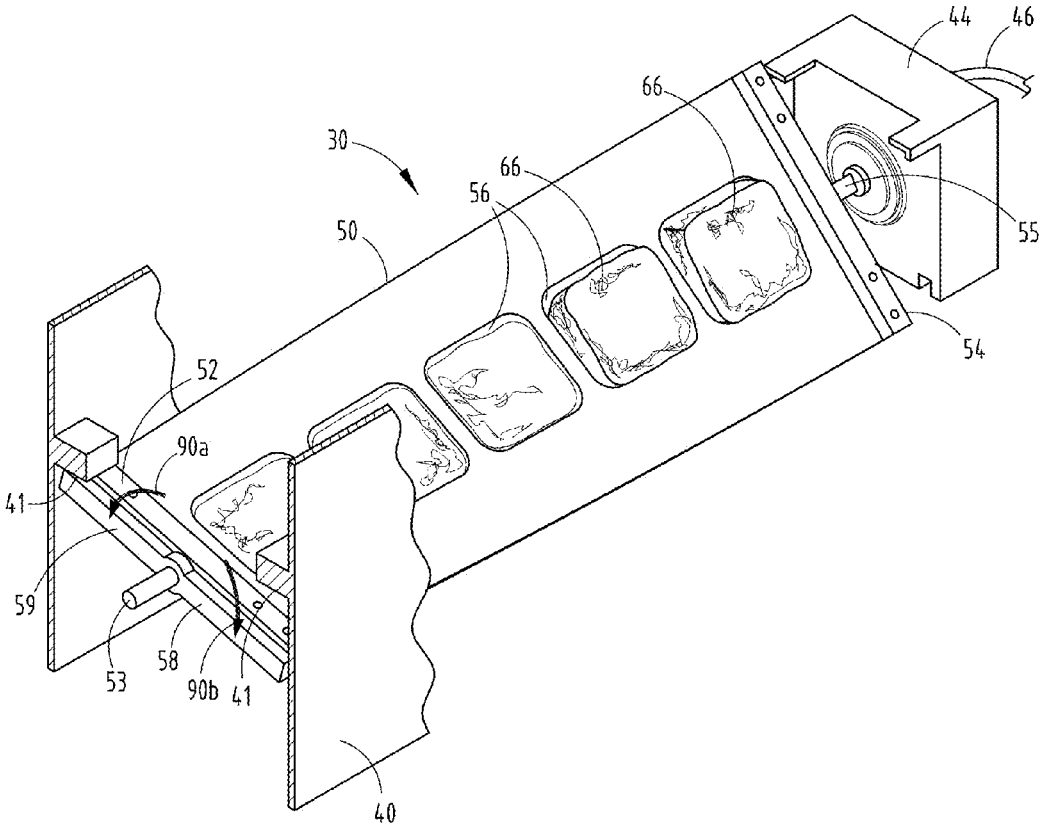
FIG. 3D is a perspective view of the dual-twist, ice-forming tray depicted in FIG. 3C, depicted in a clockwise, flexed condition during ice-harvesting operations.

FIG. 3C depicts the last phase of the ice-harvesting procedure for dual-twist tray 50. Driving body 44 continues to rotate tray 50 in a clockwise direction 90*b* despite the fact that flange 59 is pressing against frame body 40 and stopper 41. As a result, tray 50 twists and flexes in the clockwise direction 90*b* as shown in FIG. 3D. This twisting and flexing action causes the ice pieces 66 formed in recesses 56 to release from tray 50 and fall into ice collection receptacle 22 (not shown), typically without any other forces or heat being applied to the formed ice pieces 66.

In addition, dual-twist tray 50 can be rotated in a counter-clockwise direction 90*a* (see FIG. 3D) by driving body 44 to release ice pieces 66. This procedure for dual-twist tray 50 is the same as described earlier in connection with FIGS. 2A-2D. Thus, the ice-harvesting operation for dual-twist tray 50 can include a cycle of rotating the tray 50 in a counter-clockwise direction 90*a*, and then rotating the tray 50 in a clockwise rotation 90*b*. Both of these rotations cause tray 50 to flex and, together, ensure that all ice pieces 66 formed in recesses 56 are released during the ice harvesting operation, typically without any other forces or heat being applied to the formed ice pieces 66.

It should be understood that the twisting action to release ice pieces formed in recesses 56 of single- and dual-twist trays 50 can be accomplished through various, alternative approaches. For example, tray 50 and frame body 40 may be adapted for twisting rotations that exceed two twists of tray 50. Multiple rotations of tray 50 in both counter-clockwise directions 90*a* and clockwise directions 90*b* are possible before additional water is added to tray 50 for further ice piece formation.

Other twisting action approaches for tray 50 do not rely on flanges 58 and 59 (see FIGS. 1B and 1C). For example, the frame body stoppers 41 can be configured to press against the corners of tray 50 (without flanges) when the tray is rotated in a counter-clockwise direction 90*a* or clockwise direction 90*b*. A stopper 41 can be set at various lengths and dimensions to control the initial angle in which tray 50 begins to flex after the tray begin to press on stopper 41 after rotation by driving body 44 in the counter-clockwise direction 90*a* or clockwise direction 90*b*. Similarly, the dimensions and sizing of flanges 58 and 59 can also be adjusted to accomplish the same function.

As highlighted by the foregoing discussion, single-twist and dual-twist trays 50 (along with multi-twist trays 50) should possess certain thermal properties to function properly in ice-making assembly 30. The trays 50 themselves should have relatively high thermal conductivity to minimize the time necessary to freeze the ice pieces in recesses 56. Preferably, the tray 50 should possess a thermal conductivity of at least 7 $W*m^{-1}*K^{-1}$ and more preferably a thermal conductivity of at least 16 $W*m^{-1}*K^{-1}$.

Also important are the mechanical properties of tray 50. As highlighted earlier, an ice maker 20 employing ice-making assembly 30 and ice-forming tray 50 may be operated in an automatic fashion. The ice maker 20 should be reliable over the life-time of the refrigerator. Tray 50 must therefore be sufficiently fatigue resistant to survive numerous twist cycles during the ice-harvesting phase of the automatic ice-making procedure. While fatigue resistance of the frame body 40 is certainly useful, it is particularly important for tray 50 to possess high fatigue resistance. This is because the ice-harvesting aspects of the ice maker 20 primarily rely on twisting of tray 50 during operation. Frame body 40, on the other hand, experiences little motion. In addition, this level of reliability should be present at particularly cool temperatures, near or well below 0° C., temperature conducive to ice formation. Hence, tray 50 should possess at least a fatigue limit of 150 MPa over at least 100,000 cycles in tension according to ASTM E466 and E468 test specifications. Furthermore, it is believed that these fatigue properties correlate to acceptable fatigue performance of the tray 50 during the actual twisting cycles in the application of the ice-making assembly 30. For example, tray 50 should be capable of surviving 100,000 dual-twist cycles (see FIG. 3A-3D) or 200,000 single-twist cycles (see FIGS. 2A-2D).

Other mechanical properties ensure that tray 50 has the appropriate fatigue performance at temperature. For example, tray 50 should possess an elastic modulus that exceeds about 60 Gigapascals (GPa). This relatively high elastic modulus ensures that the tray 50 does not experience substantial plastic deformation during the twisting of the ice-harvesting aspect of the ice-making procedure. In addition, tray 50 should be fabricated of a material that possesses a ductile-to-brittle transition temperature of less than about 30° C. This property ensures that tray 50 does not experience an increased susceptibility to fatigue failure at lower temperatures.

Based on these mechanical and thermal property considerations, applicants presently believe that tray 50 can be comprised of any of a number of metal, ceramic, polymeric and composite materials satisfying at least these conditions. Very generally, metal materials are preferred for use in tray 50, particularly in view of the desired thermal and fatigue-related properties for the tray. Suitable metal alloy compositions include but are not limited to (a) alloys which contain at least 90% (by weight) Fe and no more than 10% of other elements; (b) alloys which contain at least 50% Fe, at least 12% Cr and other elements (e.g., Ni, Mo, etc.); (c) alloys which contain at least 50% Fe, at least 5% Ni and other elements (e.g., Cr, Mn, Mo, etc.); (d) alloys which contain at least 50% Fe, at least 5% Mn and other elements (e.g., Cr, Ni, Mo, etc.); (e) alloys which contain at least 20% Ni; (f) alloys which contain at least 20% Ti; and (f) alloys which contain at least 50% Mg. Preferably, tray 50 is fabricated from stainless steel grades 301, 304, 316, 321 or 430. In contrast, copper-based and aluminum-based alloys are not suitable for use in tray 50 primarily because these alloys have limited fatigue performance.

Water corrosion and food quality-related properties should also be considered in selecting the material(s) for tray 50. Tray 50 is employed within ice maker 20, both located within refrigerator 10 and potentially subject to exposure to food and consumable liquids. Accordingly, tray 50 should be of a food-grade quality and non-toxic. It may be preferable that the constituents of tray 50 do not leach into foods from contact exposure at temperatures typical of a standard refrigerator. For example, it may be desirable that metal alloys containing mercury and lead that are capable of leaching into the ice be avoided due to the potential toxicity of the ice produced in such trays. The tray 50 should also not corrode over the lifetime of the ice maker 20 and refrigerator 10 from exposure to water during standard ice-making operations and/or exposure to other water-based liquids in the refrigerator. In addition, material(s) chosen for tray 10 should not be susceptible to metal deposit formation from the water exposure over time. Metal deposits can impede the ability of the tray 50 to repeatedly release ice during ice-harvesting operations over the large number of twist cycles experienced by the tray during its lifetime. While it is understood that problems associated with metal deposit formation and/or corrosion can be addressed through water filtration and/or consumer interventions (e.g., cleaning of metal deposits from tray 50), it is preferable to use materials for tray 50 that are not susceptible to these water-corrosion related issues in the first instance.

Figure 4A:
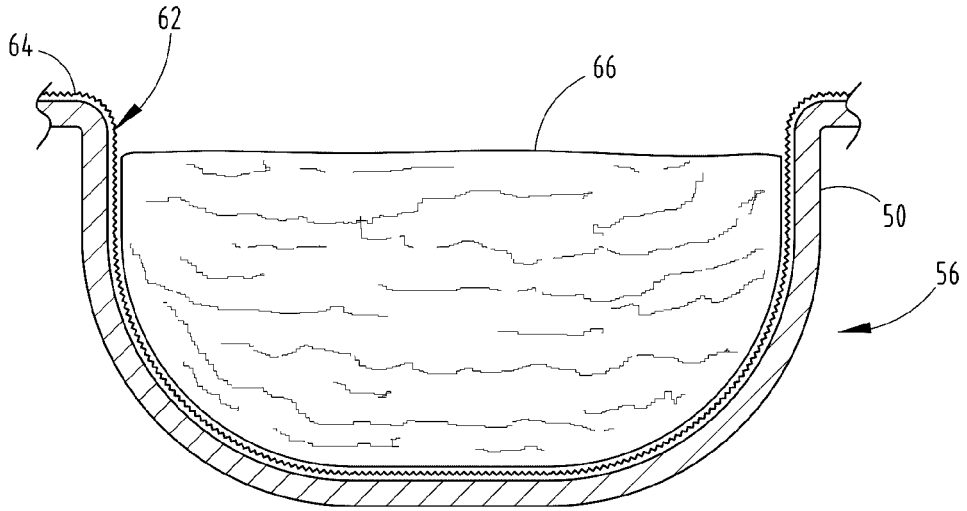
FIG. 4A is a cross-sectional, enlarged view of the ice-forming recess portion of the ice-forming tray along line IV-IV depicted in FIGS. 1B and 1C, illustrating a textured surface in the recess.
Figure 4B:
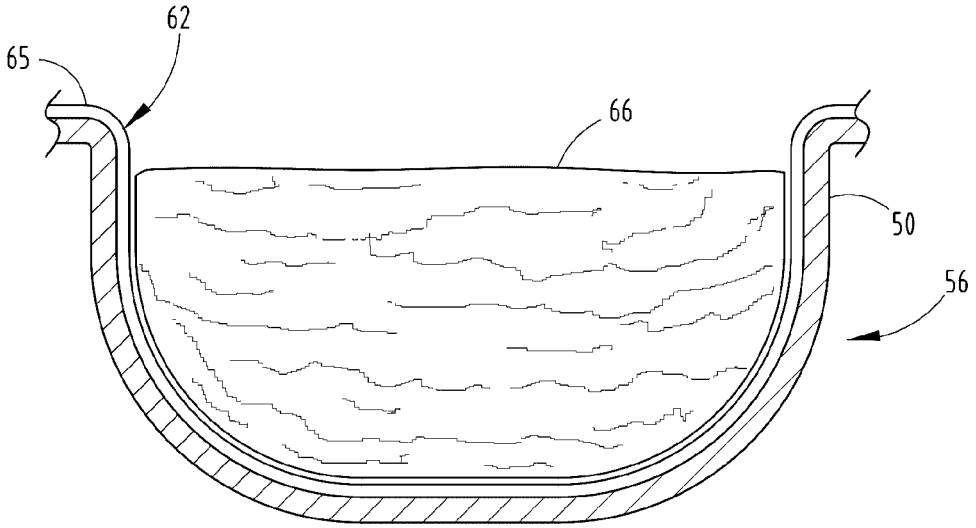
FIG. 4B is a cross-sectional, enlarged view of the ice-forming recess portion of the ice-forming tray along line IV-IV depicted in FIGS. 1B and 1C, illustrating an ice-phobic coating on the surface of the recess.

Reliable ice release during ice-harvesting operations is an important aspect of ice maker 20. As depicted in FIGS. 4A and 4B, the surfaces of ice-forming recesses 56 can be configured with ice-phobic surfaces 62. Ice-phobic surfaces 62, for example, may be a coating formed on the tray 50 or formed as part of the surface of tray 50 itself. The ice-phobic surfaces 62 are configured on at least all surfaces of recesses 56 exposed to water during the ice-formation operations of ice maker 20. Consequently, the ice-phobic surfaces 62 are in contact with ice pieces 66 within the recesses 46 of tray 50.

Referring to FIG. 4A, the ice-phobic surfaces 62 are fabricated from the surface of the tray 50 itself as textured surfaces 64. Essentially, the surfaces of tray 50 are roughened at a microscopic level to reduce the surface area between ice piece 66 and tray recess 56. This reduced surface area correlates to less adhesion between tray recess 56 and the ice piece 66.

In FIG. 4B, the ice-phobic surfaces 62 include ice-phobic structures 65. Ice-phobic structures 65 include various coatings, surface treatments and layers of material that demonstrate significant water repellency. As shown, the ice-phobic structure 65 is a coating that conforms to the surface of ice-forming recess 56. During formation and harvesting of ice pieces 66, the ice-phobic structure remains in contact with these ice pieces.

To function properly, the ice-phobic surfaces 62 should possess certain characteristics, whether configured as in FIGS. 4A, 4B or in another configuration. For example, the roughness of the surfaces 62 can contribute to the overall water repellency or hydrophobic nature of these surfaces. Accordingly, surface 62 should exhibit a roughness (Ra) from 0.02 to 2 microns. The contact angle for a droplet of water on the ice-phobic surface 62 is also a measure of its ice-phobic character. Preferably, the contact angle should approximate or exceed 90 degrees.

Figure 5A:
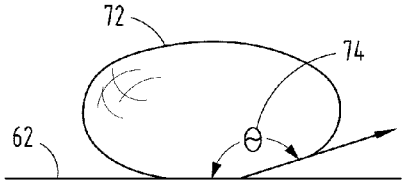
FIG. 5A is a schematic of an ice-phobic surface with a very large water contact angle ($\Theta_c$) indicative of very high water and ice-repellency.
Figure 5B:
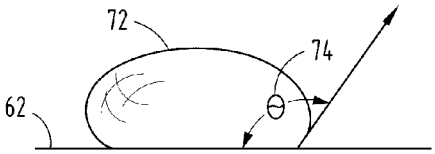
FIG. 5B is a schematic of an ice-phobic surface with a large water contact angle ($\Theta_c$) indicative of water and ice-repellency.

FIGS. 5A and 5B depict water contact angles ($\Theta_c$) 74 for a 5 ml droplet of water 72 resting on an ice-phobic surface 62. In FIG. 5A, the contact angle 74 is about 150 degrees for the particular ice-phobic surface 62, indicative of a super-hydrophobic or highly ice-phobic character (i.e., highly water repellent). FIG. 5B also demonstrates an ice-phobic surface 62 with a significant ice-phobic character as the water contact angle ($\Theta_c$) 74 is approximately 120 degrees.

Another measure of the ice-phobic character of the surface 62 is the critical, water roll-off angle ($\Theta_R$) 78 in which a 10 ml water droplet 72 will begin to roll off of a tray with a surface 62 in contact with the droplet 72. Preferably, a material should be selected for the ice-phobic surface 62 that exhibits a water roll-off angle ($\Theta_R$) of about 35 degrees or less for a 10 ml droplet of water.

Figure 6A:
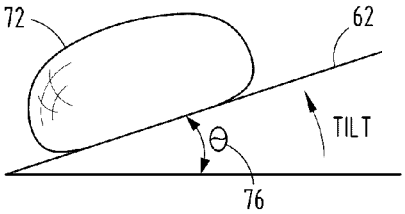
FIG. 6A is a schematic of an ice-phobic surface during a water roll-off test in which the tilt angle ($\Theta_t$) has not yet reached the water roll-off angle ($\Theta_R$) for the ice-phobic surface.
Figure 6B:
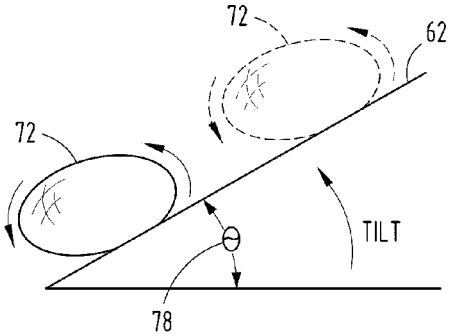
FIG. 6B is a schematic of an ice-phobic surface during a water roll-off test in which the tilt angle ($\Theta_t$) has reached the water roll-off angle ($\Theta_R$) for the ice-phobic surface.

FIGS. 6A and 6B illustrate how this test measurement is performed. In FIG. 6A, a tray containing an ice-phobic surface 62 with a 10 ml water droplet 72 is raised to a tilt angle ($\Theta_t$) 76. During the test, the tray is raised slowly until the water droplet 72 begins to roll off of the tray and ice-phobic surface 62, as depicted in FIG. 6B. The angle in which the water droplet 72 begins to roll off of the tray is the water roll-off angle ($\Theta_R$) 78 for the particular ice-phobic surface 62.

The durability of the ice-phobic surfaces 62 is also important. As discussed earlier, the ice-phobic surfaces 62 are in direct contact with water and ice pieces during the life of ice maker 20 and tray 50. Accordingly, the surfaces 62, if fabricated with an ice-phobic structure 65, must not degrade from repeated water exposure. Preferably, ice-phobic structure 65 should possess at least 1000 hours of creepage resistance under standard humid environment testing (e.g., as tested according to the ASTM A380 test specification). In addition, it is also preferable to pre-treat the surface of tray 50 before applying an ice-phobic structure 65 in the form of an ice-phobic coating. Suitable pre-treatments include acid etching, grit blasting, anodizing and other known treatments to impart increased tray surface roughness for better coating adherence. It is believed that these properties correlate to the long-term resistance of structure 65 to spalling, flaking and/or cracking during use in ice maker 20 and tray 50.

Suitable materials for ice-phobic structure 65 include fluoropolymer, silicone-based polymer and hybrid inorganic/organic coatings. Preferably, structure 65 consists primarily of any one of the following coatings: MicroPhase Coatings, Inc. and NuSil Technology LLC silicone-based organic polymers (e.g., PDMS polydimethylsiloxane), a blend of fluoropolymers and silicon carbide (SiC) particles (e.g., WHITFORD® XYLAN® 8870/D7594 Silver Gray), or THERMOLON® silica-based, sol-gel derived coating (e.g., THERMOLON® "Rocks"). Based on testing results to date, it is believed that the silicone-based organic polymer, fluoropolymer and fluoropolymer/SiC-based coatings are the most preferable for use as ice-phobic structure 65.

In general, the ice-phobic surfaces 62 allow the ice pieces 66 to easily release from tray 50 during twisting in the counter-clockwise direction 90*a* (see FIGS. 2A-2D) or clockwise direction 90*b* (see FIGS. 3A-3D). In effect, the ice pieces 66 are less likely to fracture during ice harvesting. The ice pieces 66 are also less likely to leave remnant pieces still adhered to the surfaces of recesses 56 after the ice-harvesting step. Remnant ice pieces reduce the quality of the next ice pieces 66 formed in recesses 56. Accordingly, ice pieces 66 can be harvested in a shape that nearly mimics the shape of the recesses 56 when tray 50 employs ice-phobic surfaces 62.

Furthermore, the degree of twisting necessary to release the ice pieces 66 is markedly reduced with the use of ice-phobic surfaces 62. Tables 1 and 2 below demonstrate this point. Ice-forming trays fabricated with bare SS 304 metal and fluoropolymer/SiC-coated SS 304 metal were twist tested at 0° F. (Table 1) and −4° F. (Table 2). The trays were tested with a dual-twist cycle to a successively greater twist degree. The efficacy of the ice release is tabulated. "Release of ice" means that the ice pieces generally released into a receptacle intact. "Incomplete release of ice" means that the ice pieces fractured during ice release; failed to release at all; or left significant amounts of remnant ice adhered to the ice-forming recesses in the trays. As Tables 1 and 2 make clear, the fluoropolymer/SiC-coated trays exhibited good ice release for all tested twist angles, at both 0° F. and −4° F. The bare SS 304 trays exhibited good ice release at −4° F. for twist angles of 7, 9 and 15 degrees and were less effective at ice release at 0° F.

TABLE 1

| Twist angle | Tray 1 (bare SS304); T = 0° F. | Tray 2 (fluoropolymer/ SiC-coated SS304); T = 0° F. |
|---|---|---|
| 5 | Incomplete release of ice | Release of ice |
| 7 | Incomplete release of ice | Release of ice |
| 9 | Incomplete release of ice | Release of ice |
| 15 | Incomplete release of ice | Release of ice |

TABLE 2

| Twist angle | Tray 1 (bare SS304); T = −4° F. | Tray 2 (fluoropolymer/ SiC-coated SS304); T = −4° F. |
|---|---|---|
| 5 | Incomplete release of ice | Release of ice |
| 7 | Release of ice | Release of ice |

TABLE 2-continued

| Twist angle | Tray 1 (bare SS304); T = −4° F. | Tray 2 (fluoropolymer/ SiC-coated SS304); T = −4° F. |
|---|---|---|
| 9 | Release of ice | Release of ice |
| 15 | Release of ice | Release of ice |

As is evident from the data in Tables 1 and 2, an advantage of an ice maker 20 that uses an ice-forming tray 50 with an ice-phobic surface 62, such as ice-phobic structure 65, is that less tray twisting is necessary to achieve acceptable levels of ice release. It is believed that less twisting will correlate to a longer life of the tray 50 in terms of fatigue resistance. That being said, a bare ice-forming tray also appears to perform well at a temperature slightly below freezing.

Similarly, it is possible to take advantage of this added fatigue resistance by reducing the thickness of tray 50. A reduction in the thickness of tray 50, for example, will reduce the thermal mass of tray 50. The effect of this reduction in thermal mass is that less time is needed to form ice pieces 66 within the recesses 56. With less time needed to form the ice pieces 66, the ice maker 20 can more frequently engage in ice harvesting operations and thus improve the overall ice throughput of the system. In addition, the reduction in the thickness of tray 50 should also reduce the amount of energy needed to form the ice pieces 66, leading to improvements in overall energy efficiency of refrigerator 10.

Another benefit of employing an ice-phobic structure 65 in the form of an ice-phobic coating, such as fluoropolymer/SiC, is the potential to use non-food grade metals for tray 50. In particular, the ice-phobic structure 65 provides a coating over the ice-forming recesses 56. Because these coatings are hydrophobic, they can be effective at creating a barrier between moisture and food with the base material of tray 50. Certain non-food grade alloys (e.g., a low-alloy spring steel with a high elastic limit) can be advantageous in this application because they possess significantly higher fatigue performance than food-grade alloys. Consequently, these non-food grade alloys may be employed in tray 50 with an ice-phobic structure 65 in the form of a coating over the tray 50. As before, the thickness of tray 50 can then be reduced, with some of the same benefits and advantages as those discussed earlier in connection with the reduced twist angle needed for ice release when tray 50 possesses an ice-phobic structure 65 in the form an ice-phobic coating.

The design of ice-forming tray 50 for use in ice maker 20 also should take into account various considerations related to ice pieces 66 and recesses 56. In general, many consumers desire small, cube-like ice pieces. Other consumers prefer egg-shaped pieces. Still others desire fanciful shapes that may appeal to a younger audience. Ultimately, the design approach for ice-forming tray 50 for use in ice maker 20 should be flexible to allow for different shapes and sizes of ice pieces 66.

The shapes and sizes of ice pieces 66 (and ice-forming recesses 56) also impact the throughput of ice maker 20, along with the reliability and manufacturability of tray 50. In terms of throughput, the size of the ice pieces 66 affects the overall throughput of ice maker 20 in terms of pounds of ice per day. While many consumers desire small, cube-like ice pieces, the relatively small volume of these ice pieces likely translates into more twist cycles for tray 50 over its lifetime for ice maker 20 to produce the necessary amount of ice by weight.

Similarly, the shape of ice pieces 66 and recesses 56 play a large role in the fatigue resistance of tray 50. When ice-forming recesses 56 are configured in a more cube-like shape (see, e.g., FIGS. 1B and 1C), the tray 50 will contain many areas where the radius between the edge of a recess 56 and a level portion of tray 50 decreases. The net result is a set of features on the tray 50 that can concentrate stresses during the flexing associated with the ice-harvesting operations. This is another reason why the materials selected for use with tray 50 should possess good fatigue resistance.

In addition, the shape of ice pieces 66 may also affect the efficacy of ice release for tray 50. When ice pieces 66 take a cube-like shape (see, e.g., FIGS. 1B and 1C), consistent release of the ice pieces may be more difficult for a given degree of twisting of tray 50. Conversely, ice pieces 66 shaped with more curvature (see, e.g., FIG. 7) can be more easily released for a given degree of twisting of tray 50.

The shape and size of ice pieces 66 also impact the manufacturability of tray 50. When tray 50 is made from a metal alloy, stamping methods can be used to fabricate the tray. Stretch forming and drawing processes may also be used to fabricate the tray 50. All of these procedures rely on the ductility of the alloy to allow it to be shaped according to the desired dimensions of the tray 50 and its recesses 56. In general, more complex shapes for recesses 56 correlated to more demanding stamping processes. The same stress concentrations in tray 50 associated with more cube-like recesses 56 that affect fatigue resistance also can lead to tray failure during the stamping process. Accordingly, another consideration for the material selected for tray 50 is to ensure that it possesses an adequate amount of ductility. One measure of ductility is the strain-hardening exponent (n) (e.g., tested according to ASTM test specifications E646, E6 and E8). Preferably, a metal alloy employed for use in tray 50 should possess a strain-hardening exponent (n) greater than 0.3.

Figure 7:
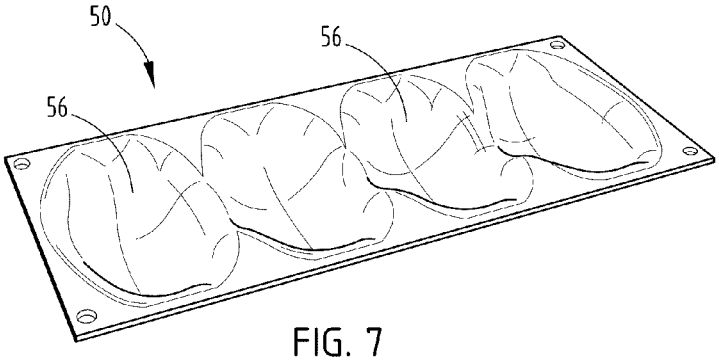
FIG. 7 is a perspective view of an ice-forming tray with half, egg-shaped ice-forming recesses.
Figure 7A:
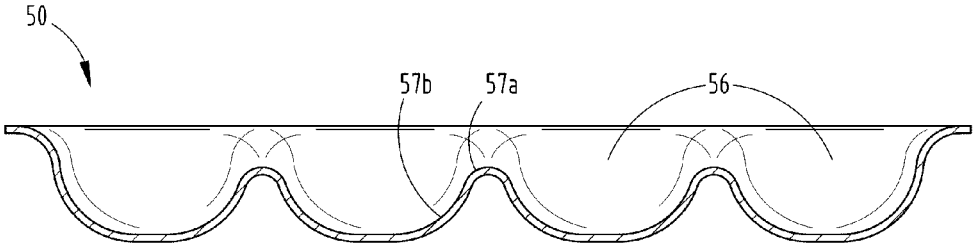
FIG. 7A is a cross-sectional view of the ice-forming tray depicted in FIG. 7 taken along line VII A-VII A.
Figure 8:
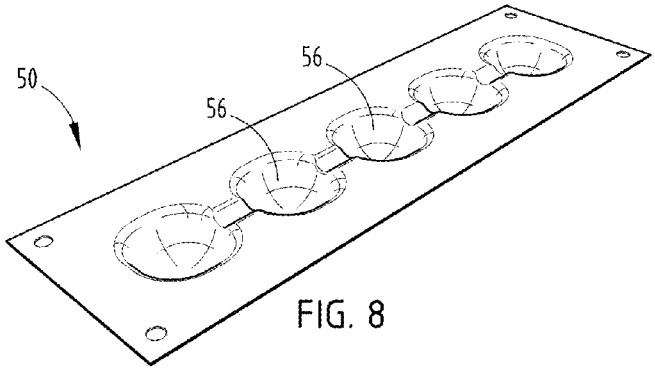
FIG. 8 is a perspective view of an ice-forming tray with rounded, cube-shaped ice-forming recesses.
Figure 8A:
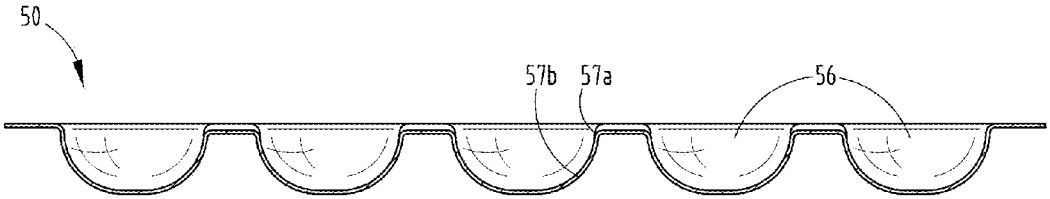
FIG. 8A is a cross-sectional view of the ice-forming tray depicted in FIG. 8 taken along line VIII A-VIII A.
Figure 9:
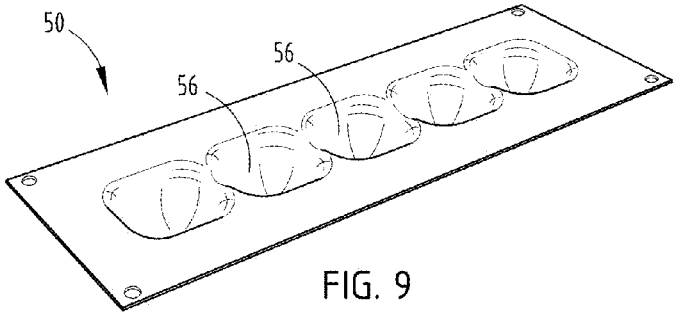
FIG. 9 is a perspective view of an ice-forming tray with rounded, cube-shaped ice-forming recesses that include straight side walls and a straight bottom face.
Figure 9A:
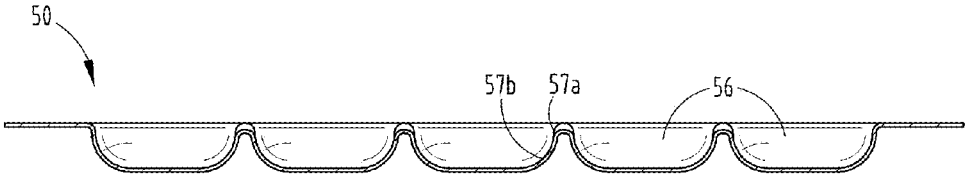
FIG. 9A is a cross-sectional view of the ice-forming tray depicted in FIG. 9 taken along line IX A-IX A.

Three designs for tray 50 are illustrated in FIGS. 7, 7A, 8, 8A, 9 and 9A that take into account the considerations discussed above for tray 50, ice pieces 66 and ice-forming recesses 56. FIGS. 7 and 7A depict an ice-forming tray 50 with half, egg-shaped ice-forming recesses 56. FIGS. 8 and 8A depict an ice-forming tray 50 with rounded, cube-shaped ice-forming recesses 56. FIGS. 9 and 9A depict an ice-forming tray 50 with rounded, cube-shaped ice-forming recesses 56 that include straight side walls and a straight bottom face. It should be understood, however, that various designs for tray 50 and recesses 56 are feasible for use with ice maker 20. Preferably, designs for tray 50 should take into account the considerations discussed above—tray manufacturability, tray fatigue life, ice-forming throughput, and consumer preferences associated with the shape and size of ice pieces 66.

The particular tray 50 depicted in FIGS. 7 and 7A with half, egg-shaped ice-forming recesses 56 is indicative of a tray design offering good formability, relatively high ice piece volume and fatigue resistance. As is evident in the figures, the half, egg-shape of the recesses 56 is a generally round shape. Further, the recess entrance radius 57*a* and recess bottom radius 57*b* are relatively large at 6 and 30 mm, respectively. These aspects of the design for tray 50 minimize regions of high stress concentration. The primary drawback of the design for tray 50 shown in FIGS. 7 and 7A, however, is that many consumers prefer ice-cubes that are more cube-like and larger than the ice pieces 66 that can be formed in recesses 56 of this design for tray 50.

In contrast, the two designs for tray 50 depicted in FIGS. 8 and 8A, and 9 and 9A can produce cube-like ice pieces 66. Both of these tray designs produce ice pieces 66 that are smaller than the ice pieces that can be formed from the tray 50 depicted in FIGS. 7 and 7A. Accordingly, five ice-forming recesses 56 are configured within tray 50 in these tray designs compared to only four ice-forming recesses 56 in the half, egg-shaped tray design depicted in FIGS. 7 and 7A. Further, the designs for tray 50 shown in FIGS. 8-9A possess ice-forming recesses 56 with sharper corners associated with a more cube-like ice piece 66 compared to the half, egg-shaped tray design depicted in FIGS. 7 and 7A. In particular, the recess entrance radius 57*a* and recess bottom radius 57*b* are 4 and 10 mm, respectively, for the design of tray 50 depicted in FIGS. 8 and 8A. Recess entrance radius 57*a* is measured between the vertical wall of recess 56 and the horizontal lip of tray 50. Recess bottom radius 57*b* is measured between the bottom face of recess 56 (parallel to the horizontal lip of tray 50) and the vertical wall of recess 56. Similarly, the recess entrance radius 57*a* and recess bottom radius 57*b* are 2.4 and 12 mm, respectively, for tray 50 depicted in FIGS. 9 and 9A.

In essence, the tray designs depicted in FIGS. 8-9A that produce cube-like ice pieces 66 are more difficult to fabricate and slightly less fatigue resistant than the tray design depicted in FIGS. 7 and 7A. However, these designs for tray 50 can produce small ice pieces 66 in the shape of a cube—a feature highly desirable to many consumers. When made from the fatigue resistant materials described earlier, these tray designs can perform effectively as tray 50 in an ice maker 2 configured for automatic ice-making operations. In addition, these designs for tray 50 may also employ an ice-phobic surface 62 within the recesses 56 to afford additional design flexibility for the shape and configuration of the ice pieces 66. As discussed earlier, these surfaces 62 offer the benefit of reduced, twist angles for tray 50 necessary for ice-harvesting. It is believed that a reduced twist angle should provide a reliability benefit for tray 50. This benefit can then be used to design recesses 56 to produce ice pieces 66 that are more cube-like, despite higher stress concentrations in tray 50 during fabrication and in operation.

Although tray material selection and ice-piece shape affect the durability of tray 50 employed within ice maker 20, the degree of clockwise and counter-clockwise twisting of tray 50 (see FIGS. 2A-2D; 3A-3D) also plays a significant role. The control and gearing of driving body 44, location and sizing of frame body stoppers 41 and tray flanges 58 and 59 can be adjusted and modified to select the desired twist angle for tray 50 during ice-harvesting operations. Further, greater degrees of twisting applied to tray 50 to release ice pieces 66 result in higher applied stresses to tray 50 over each twist cycle. Stresses that exceed the fatigue limit of a given material used for tray 50 can lead to premature failure. In addition and as discussed earlier, stress concentration regions exist within tray 50 near the interfaces between the level portion of the tray and recesses 56.

Figure 10:
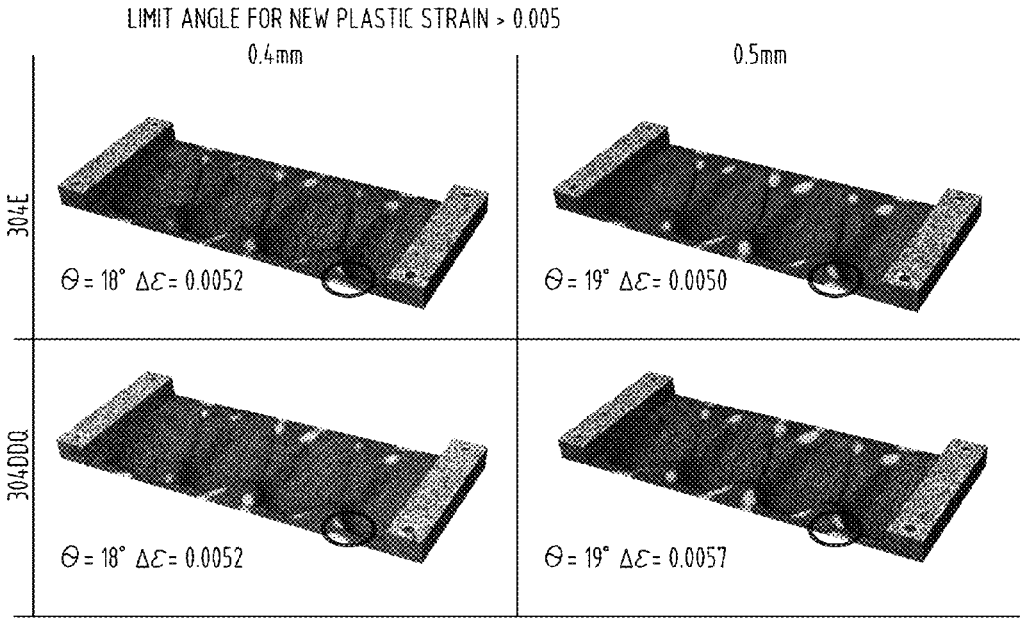
FIG. 10 provides finite element analysis plots of 0.4 and 0.5 mm thick ice-forming trays with half, egg-shaped ice-forming recesses stamped from stainless steel grades 304E and 304DDQ that depict the maximum single-twist angle at a plastic strain of approximately 0.005.

FIG. 10 provides four finite element analysis (FEA) plots of strain within a tray 50 with half, egg-shaped recesses 56 fabricated out of grade 304E and 304DDQ stainless steel (i.e., SS 304E and SS 304DDQ) at thicknesses of 0.4 and 0.5 mm. These plots show the results from simulated twisting of these trays during ice-harvesting operations. More specifically, the FEA plots in FIG. 10 list the twist angle in which some portion of each tray 50 begins to experience some appreciable plastic deformation during the twisting simulation (i.e., strain equal or greater than 0.005). A material subject to plastic deformation likely will exhibit a low fatigue resistance. As the plots in FIG. 10 show, the twist angle for the 0.4 mm thick trays made from SS 304E and SS 304DDQ corresponding to the onset of plastic deformation is approximately 18 degrees. The trays with a thickness of 0.5 mm possess a comparable twist angle of 19 degrees.

What these plots demonstrate is that the interfaces between the ice-forming recesses 56 and the horizontal, level portion of tray 50 are where the stresses are highest during twisting. At these locations, the strain approaches 0.005 (i.e., there is some degree of plastic deformation) at the specified twist angle. Accordingly, preferred designs for tray 50, including those depicted in FIGS. 7-9A, possess a relatively large recess entrance radius 57*a*.

In addition, the FEA plots in FIG. 10 demonstrate that fatigue performance of the tray 50 is sensitive to tray thickness. An increase in tray thickness from 0.4 to 0.5 mm increased the critical twist angle by one degree. It stands to reason that a thicker tray capable of being flexed to a higher degree before plastic deformation should have superior fatigue performance. Hence, preferred designs for tray 50, including those shown in FIGS. 7-9A, should possess a tray thickness chosen to optimize fatigue performance via less sensitivity to twist angle. But the thickness for tray 50 should not be made at the expense of thermal conductivity, a property that affects the speed in which ice pieces 66 can be formed in ice maker 20.

Figure 11:
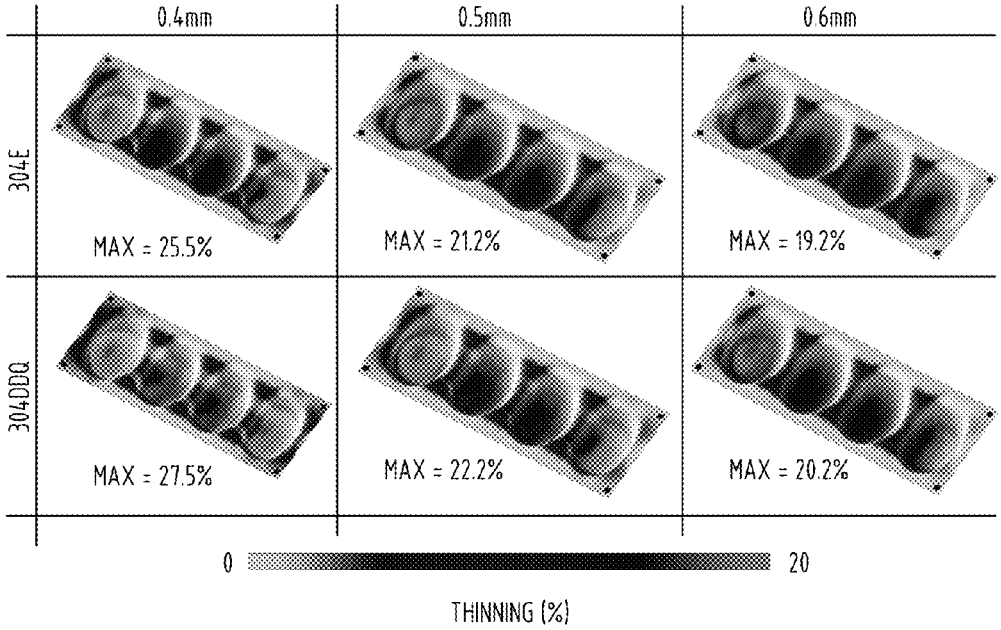
FIG. 11 provides finite element analysis plots of 0.4, 0.5 and 0.6 mm thick ice-forming trays with half, egg-shaped ice-forming recesses stamped from stainless steel grades 304E and 304DDQ that depict the maximum degree of thinning to the walls of the ice-forming recesses during tray fabrication via a stamping process.

Because fatigue performance is likely affected by the thickness of tray 50, it is believed that the tray forming methods discussed earlier, e.g., stamping, drawing and stretching, could limit the reliability of tray 50 used in ice maker 20. This is because each of these fabrication processes result in some degree of thinning to the thickness of tray 50. FIG. 11 provides finite element analysis plots that demonstrate this point. These plots depict the results from a simulated stamping process on 0.4, 0.5 and 0.6 mm thick ice-forming trays with half, egg-shaped ice-forming recesses. The trays are made from SS 304E and SS 304DDQ and the plots show the maximum degree of thinning to the walls of the ice-forming recesses during tray fabrication via the stamping process. The plots show that the differences in thinning between the trays made from SS 304E and SS 304DDQ are minimal. On the other hand, the degree of thinning is reduced by increases to the tray thickness. More importantly, the magnitudes of the thinning experienced by each of these ice-forming trays are significant and range from 19 to 28%.

Reducing or eliminating the degree of thinning of the walls of ice-forming recesses 56 during tray fabrication should yield benefits to the reliability of tray 50 during its lifetime within ice maker 20. High-velocity tray fabrication methods, such as electromagnetic and explosive metal forming processes, should be able to produce ice-forming trays 50 with significantly less thinning than stamping, drawing or stretching processes. Applicants presently believe that these high-velocity processes likely will generate more uniform stresses and strain in tray 50 during fabrication. The material properties of trays 50 formed with high-velocity fabrication methods are expected to possess more uniform material properties.

Tray 50 likely will also possess less of the standard wrinkling effects associated with stamping, drawing or stretching fabrication methods. The net effect is less, localized thinning of the part, particularly in the ice-forming recesses 56. This should lead to higher reliability of the tray 50 (i.e., less chance for cracking) based on the results shown in FIG. 10, for example. Alternatively, these high-velocity forming processes should result in less fatigue susceptibility to higher degrees of twisting of tray 50 during ice-harvesting. Accordingly, a tray 50 formed with a high-velocity fabrication process (e.g., electromagnetic or explosive metal forming) can be twisted to a larger degree than a tray 50 formed with a stamping process. Hence, an ice maker 20 that employs a high-velocity-formed tray 50 is capable of producing ice pieces 66 that are less likely to fracture during ice release; fail to release at all; or partially adhere to the recesses 56.

Other variations and modifications can be made to the aforementioned structures and methods without departing from the concepts of the present invention. For example, other ice-making configurations capable of heater-less, single twist and heater-less, dual twist ice piece harvesting may be employed. Variations may be made to the ice-forming tray configurations disclosed (with and without ice-phobic surfaces) that optimally balance tray fatigue life, ice piece throughput, and ice piece aesthetics, among other considerations.

We claim:

1. An ice maker assembly, comprising:

an ice maker with a heaterless tray having recesses with ice-phobic surfaces for direct contact with ice pieces formed in the recesses, a first flange and a second flange;

a frame body that is coupled to the tray and comprises a first stopper and a second stopper; and a driving body that is rotatably coupled to the tray, wherein the tray is formed from a metal material, wherein the driving body is adapted to rotate the tray in a cycle with clockwise and counter-clockwise motions such that the first and second flange alternate pressing against the respective first and second stopper in a manner that flexes the tray to dislodge ice pieces formed in the recesses, and further wherein the ice-phobic surfaces comprise the metal material, are formed from the tray, and have a surface roughness (Ra) from 0.02 to 2 microns.

2. The ice maker assembly according to claim 1, wherein the metal material possesses a thermal conductivity of at least 7 W/m*K.

3. The ice maker assembly according to claim 1, wherein the metal material is a stainless steel.

4. An ice maker assembly, comprising:

an ice maker with a heaterless tray having recesses with ice-phobic surfaces for direct contact with ice pieces formed in the recesses, a first flange and a second flange;

a frame body that is coupled to the tray and comprises a first stopper and a second stopper; and a driving body that is rotatably coupled to the tray, wherein the tray is formed from a metal material exhibiting a fatigue limit greater than about 150 MPa at $10^5$ fatigue test cycles, wherein the driving body is adapted to rotate the tray in a tray rotation cycle with clockwise and counter-clockwise motions such that the first and second flange alternate pressing against the respective first and second stopper in a manner that flexes the tray to dislodge ice pieces formed in the recesses, and further wherein the ice-phobic surfaces comprise the metal material, are formed from the tray, and have a roughness (Ra) from 0.02 to 2 microns.

5. The ice maker assembly according to claim 4, wherein the metal material possesses a thermal conductivity of at least 7 W/m*K.

6. The ice maker assembly according to claim 4, wherein the metal material is a stainless steel.

7. The ice maker assembly according to claim 4, wherein the driving body is further adapted to rotate the tray a maximum of 15 degrees from horizontal such that the tray presses against the frame body in a manner that flexes the tray to dislodge the ice pieces formed in the recesses.

8. The ice maker assembly according to claim 4, wherein the tray is formed with a high velocity fabrication process to impart sufficient fatigue resistance to the tray allowing it to withstand at least $10^5$ tray rotation cycles.

* * * * *